US007497104B2

(12) United States Patent
Bindernagel et al.

(10) Patent No.: US 7,497,104 B2
(45) Date of Patent: Mar. 3, 2009

(54) ROLLING STAND, AND METHOD FOR DETERMINING THE ROLLING FORCE IN A ROLLING STAND

(75) Inventors: Ali Bindernagel, Solingen (DE); Heinrich Potthoff, Hilden (DE)

(73) Assignee: KOCKS Technik GmbH & Co. KG, Hilden (DE)

( * ) Notice: Subject to any disclaimer, the term of this patent is extended or adjusted under 35 U.S.C. 154(b) by 44 days.

(21) Appl. No.: 11/678,840

(22) Filed: Feb. 26, 2007

(65) Prior Publication Data

US 2007/0199358 A1 Aug. 30, 2007

(30) Foreign Application Priority Data

Feb. 24, 2006 (DE) ..... 10 2006 009 173

(51) Int. Cl.
*B21B 37/58* (2006.01)

(52) U.S. Cl. ..... 72/10.4; 72/14.4

(58) Field of Classification Search ..... 72/10.1, 72/10.2, 10.4, 10.6, 13.4, 14.4, 14.5, 237, 72/240, 241.4, 248, 252.5
See application file for complete search history.

(56) References Cited

U.S. PATENT DOCUMENTS

| | | | | |
|---|---|---|---|---|
| 3,306,091 | A * | 2/1967 | Bursk | 72/240 |
| 3,691,810 | A * | 9/1972 | Tadeusz | 72/234 |
| 3,861,187 | A | 1/1975 | Leeuwestein | |
| 4,490,264 | A * | 12/1984 | Gerkema et al. | 428/642 |
| 4,962,655 | A * | 10/1990 | Nonini | 72/14.4 |
| 5,115,653 | A * | 5/1992 | Beisemann et al. | 72/10.4 |
| 5,187,960 | A * | 2/1993 | Taguchi | 72/14.4 |
| 6,041,635 | A | 3/2000 | Cattaneo et al. | |
| 6,418,767 | B2 * | 7/2002 | Shinbutsu et al. | 72/10.2 |
| 6,601,424 | B2 * | 8/2003 | Bagusche | 72/110 |

FOREIGN PATENT DOCUMENTS

| | | |
|---|---|---|
| DE | 2 259 143 | 6/1974 |
| DE | 41 21 116 A1 | 1/1993 |
| EP | 0 479 750 A1 | 4/1992 |

* cited by examiner

*Primary Examiner*—Edward Tolan
(74) *Attorney, Agent, or Firm*—Henry M. Feiereisen; Ursula B. Day

(57) ABSTRACT

A rolling stand includes at least one roller having a roller journal which is rotatably supported by an eccentric bushing which in turn is rotatably supported by a low-friction bearing unit. An adjusting mechanism exerts an adjusting force on the eccentric bushing for rotating the eccentric bushing with respect to the housing and maintaining the eccentric bushing in a desired position. In order to determine a rolling force in the rolling stand, the eccentric bushing is rotated to a desired position relative to the housing by the adjusting mechanism, and an effective adjusting force in the adjusting mechanism is measured when the eccentric bushing is held in the desired position. The rolling force can then be ascertained on the basis of the measured adjusting force.

18 Claims, 2 Drawing Sheets

ROLLING STAND, AND METHOD FOR DETERMINING THE ROLLING FORCE IN A ROLLING STAND

CROSS-REFERENCES TO RELATED APPLICATIONS

This application claims the priority of German Patent Application, Serial No. 10 2006 009 173.6, filed Feb. 24, 2006, pursuant to 35 U.S.C. 119(a)-(d), the content of which is incorporated herein by reference in its entirety as if fully set forth herein.

BACKGROUND OF THE INVENTION

The present invention relates to a method for determining the rolling force in a rolling stand, as well as to a rolling stand.

Nothing in the following discussion of the state of the art is to be construed as an admission of prior art.

U.S. Pat. No. 3,861,187 discloses a rolling stand for rolling rod-shaped or tubular material, with three rollers which are arranged in a star configuration about the longitudinal axis of the rolling stock. The roller journals disposed at the ends of at least one of the three rollers are eccentrically supported in respective eccentric bushings which have an inner, circular opening in which the radial bearing, preferably a roller bearing, of the roller journal is placed. The circular outer circumference of the eccentric bushing is supported in the housing of the rolling stand. The eccentricity of the eccentric bushing is due to the fact that the circle formed by the interior surface of the eccentric bushing and the circle formed by the exterior surface of the bushing are not coaxially aligned. Further described in U.S. Pat. No. 3,861,187 is the use of such roller design for adjusting the rollers in a rolling stand, e.g. for moving the rollers toward the rolling stock.

U.S. Pat. No. 3,861,187 further describes an adjusting mechanism for moving the eccentric bushing into a desired rotational position relative to the housing. A rotary motion of an adjusting shaft having an adjusting ring is transmitted to the eccentric bushing via an adjusting pin disposed on a rotatable adjusting spindle and a transfer lever which is flexible connected both with the adjusting ring and the eccentric bushing. Alternatively, a threaded spindle which is stationarily supported in the axial direction and on which a threaded bushing moves in the axial direction, can be used. The threaded bushing is connected with the adjusting ring via an articulated joint, with the adjusting ring encompassing a cup-shaped projection of the eccentric bushing and being non-rotatably connected with the eccentric bushing through a tight-fitting spring. These adjusting mechanisms enable rotation of the eccentric bushing relative to the housing in which the bushing is supported. The eccentric bushing can be held in the desired set position by blocking rotation of the threaded spindle. As a result, the radial spacing or gap between the rollers in a rolling stand can be adjusted for changing the diameter of the finished rolling stock and/or for compensating temperature-induced changes in the dimensions of the rolling stock or wear of the rollers.

U.S. Pat. No. 3,861,187 further discloses the support of the eccentric bushing in the housing by a friction bearing, i.e., the exterior surface of the eccentric sleeve slides on a surface of the housing when the eccentric bushing is adjusted. The gap can therefore only be adjusted when rolling stock is absent from the rolling stand. Otherwise, the eccentric bushing is subjected to the rolling force, which increases the tangential sliding friction forces between the housing of the rolling stand and the eccentric sleeve.

U.S. Pat. No. 6,041,635 discloses a different approach for adjusting the rollers of a rolling stand for rolling rod-shaped or tubular stock. The rollers are supported in stirrup-shaped brackets movable inside the frame along a longitudinal axis which is perpendicular to the rolling axis. The brackets are moved by hydraulic cylinders, wherein the piston ends can cooperate with the brackets and adjust the rollers by moving the brackets with the piston. The rolling force may then be determined by measuring the hydraulic pressure applied to the hydraulic cylinder.

However, adjusting the rollers with hydraulic cylinders has significant disadvantages:

If the hydraulic cylinders are part of an exchangeable rolling stand, i.e., if the hydraulic cylinders do not remain with the rolling mill when the rolling stand is changed (e.g., when changing product dimensions or gauge), then the feed line to each cylinder arranged in the rolling stand must be connected by way of a releasable hydraulic coupling. This is technically complex and can make a trouble-free operation of such rolling mill more difficult.

Conversely, if the hydraulic cylinders are fixedly installed in the rolling mill and therefore remain in the rolling mill when the rolling stand is changed, then several significant disadvantages result:

- The rolling forces are not absorbed in the rolling stand itself, but in the support bearings of the hydraulic cylinders and are therefore transmitted to the steel frame of the rolling mill, requiring a massive and therefore rather expensive steel frame.
- Removing the rolling stands from the rolling mill also increases the complexity in the construction and design, because of the hydraulic cylinders are arranged in a star pattern around the rolling access, so that the rolling stands can no longer be pulled out perpendicular to the rolling axis.
- When the rolling stands are not installed in the rolling mill, the so-called rolling gauge defined by the three cooperating rollers cannot be controlled, because the components that determine the accuracy, namely the hydraulic cylinders, are located in the rolling mill. However, if the rolling stands are installed in the rolling mill, then the gauge can also not be controlled due to the lack of access.

Adjusting the rollers in opposition to the rolling force with hydraulic cylinders is extremely expensive.

The system does not have an inherent fail-safe function, so that a hydraulic failure halts the rolling process.

It would therefore be desirable and advantageous to provide an improved method and system for measuring the applied rolling force in the presence of rolling stock, which obviates prior art shortcomings and is able to specifically adjust the rollers during the rolling process in the presence of the rolling force.

SUMMARY OF THE INVENTION

According to one aspect of the invention, a method for determining a rolling force in a rolling stand, with the rolling stand having at least one roller with a roller journal (or roller shaft) rotatably supported in an eccentric bushing which is rotatably supported in a housing of the rolling stand by a low-friction bearing unit, includes the steps of rotating the eccentric bushing to a desired position relative to the housing with an adjusting mechanism, measuring an effective adjusting force in the adjusting mechanism when the eccentric bushing is held in the desired position, and determining a rolling force from the measured adjusting force.

According to another aspect of the invention, a rolling stand includes a housing, at least one roller having a roller journal (or roller shaft), an eccentric bushing rotatably supporting the roller journal, a low-friction bearing unit for rotatably supporting the eccentric bushing in the housing, an adjusting mechanism adapted to exert an adjusting force on the eccentric bushing for rotating the eccentric bushing with respect to the housing and maintaining the eccentric bushing in a desired position, and a measuring device for measuring the adjusting force.

The present invention resolves prior art problems by supporting the eccentric bushing, unlike the bushing disclosed in DE 22 59 143, by a low-friction bearing unit, so that the restoring torque exerted on the eccentric bushing by the rolling force is no longer inhibited by a friction torque of the support of the eccentric bushing that acts in the opposite direction of the restoring torque. In other words, the restoring torque composed of the rolling force and the eccentricity of the eccentric bushing is no longer predominantly transferred by friction to the housing, but is entirely received by the adjusting mechanism which holds the eccentric bushings in the desired position. As a result, forces, torques and stress acting in the components of the adjusting mechanism are jointly proportional to the effective rolling force in a given position of the eccentric bushing. Consequently, the effective rolling force can be determined by measuring the force (or a torque or a strain) acting at a location in the adjusting mechanism. Instead of determining the effective rolling force from the adjusting force acting on the adjusting mechanism, the effective rolling force can also be determined from the pressing force applied by the adjusting mechanism on the stationary housing, because this pressing force is proportional to the force in the adjusting mechanism and hence also the effective rolling force.

In the following description, the term "low-friction bearing" is to be understood as a bearing by which the friction torque opposing the adjustment motion is negligibly small compared to the adjusting force required for holding the eccentric bushing in the desired position. A low-friction bearing more particularly refers to a bearing, wherein the friction coefficient $\mu$ is $<0.2$, in particular $\mu<0.1$ and most preferably $\mu<0.05$. Examples of a low-friction bearing unit include a needle bearing or a so-called hydro-bearing. Suitably, a friction-reducing fluid may be disposed between an exterior surface of the eccentric bushing and an opposing interior surface of the housing. Alternatively, one or both of the opposing surfaces of the bearing implemented as a low-friction bearing may have a friction-reducing coating.

In accordance with the present invention, the adjusting force can be measured when the eccentric bushing is held in the desired position and as a result the rolling force can be determined.

The rolling force is determined by measuring the adjusting force applied by the adjusting mechanism and a pivot angle by which the eccentric bushing is rotated from an initial or reference position to the desired position relative to the housing. For a known angular position, the fixed eccentricity of the eccentric bushing as determined by its design defines the effective lever arm of the effective rolling force and thereby a direct relationship between the rolling force and the force or the torque measured in the adjusting mechanism.

The method of the invention may be employed, in particular, in a rolling stand for rolling rod-shaped or tubular stock, wherein at least three rollers are arranged in a star configuration about the longitudinal axis of the rolling stock for sizing.

The rolling force determined with the method of the invention can preferably be employed for controlling a rolling process. For example, information about the rolling force can be used as a regulating variable for controllably varying the exit cross-section over the length of the rod. Alternatively, measuring the rolling force allows detection and compensation of the known elastic spring-back of the stand.

Continuous measurement of the rolling force may also enable further improvements of the mathematical models describing the material deformation, with the goal to improve the accuracy of the calculated preset parameters of the rolling stands.

The measured rolling force can also be used for correcting and improving the precision of material data stored in a database, for example the yield strength, which frequently form the basis for control processes and affect the accuracy of controllers using these control processes.

The adjusting mechanism which can be employed with the method according to the invention and with the rolling stand according to the invention, can be designed in several different ways. Preferably, at least one eccentric bushing includes a gear ring which cooperates with a gear wheel or a gear wheel segment of the adjusting mechanism, so that rotation of the gear wheel can cause a rotation of the eccentric bushing. Alternatively, the adjusting mechanism may be implemented as a worm gear, wherein at least one of the eccentric bushings comprises a worm wheel or a worm wheel segment which cooperates with the worm. The adjusting force can be determined by measuring the torque acting on the gear wheel or the worm wheel, or a segment thereof. Other adjusting mechanisms, such as the conventional adjusting mechanisms disclosed in DE 22 59 143, can also be employed.

BRIEF DESCRIPTION OF THE DRAWING

Other features and advantages of the present invention will be more readily apparent upon reading the following description of currently preferred exemplified embodiments of the invention with reference to the accompanying drawing, in which.

DETAILED DESCRIPTION OF PREFERRED EMBODIMENTS

Figure 1:
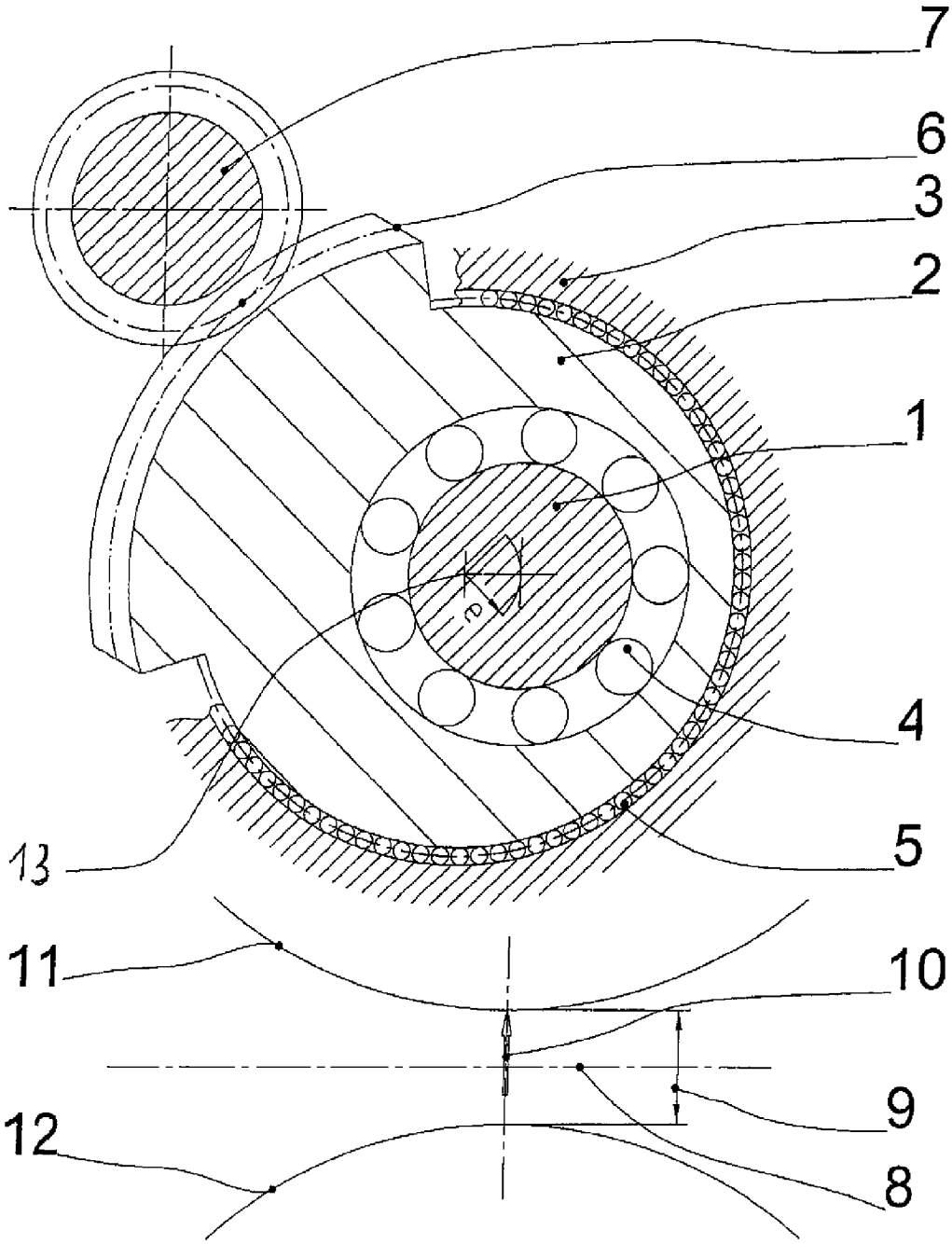
FIG. 1 shows a schematic side view of a support of the roller journal of a rolling stand according to the invention, as well as an adjusting mechanism.

Throughout all the Figures, same or corresponding elements are generally indicated by same reference numerals. These depicted embodiments are to be understood as illustrative of the invention and not as limiting in any way. It should also be understood that the drawings are not necessarily to scale and that the embodiments are sometimes illustrated by graphic symbols, phantom lines, diagrammatic representations and fragmentary views. In certain instances, details which are not necessary for an understanding of the present invention or which render other details difficult to perceive may have been omitted.

Turning now to the drawing, and in particular to FIG. 1, there is shown a schematic side view of a support of a roller journal 1 of a roller of an otherwise unillustrated rolling stand having a roller, of which only the surface segment 11 is depicted. The roller journal 1 is supported in an eccentric bushing 2 by a radial bearing 4. The eccentric bushing 2 is supported in the housing 3 of the rolling stand by a needle bearing 5. The eccentric bushing 2 has a gear ring segment 6 which is in engagement with a pinion 7 of the adjusting mechanism. The adjusting mechanism has a measuring device (not shown in detail) for measuring an adjusting force 22 (see FIG. 2) applied to hold the eccentric bushing 2 in the illustrated position.

A rolling gap 9 is formed between the roller (indicated by surface segment 11) and an opposing roller, of which likewise also only a surface segment 12 is illustrated. The rolling stock (not shown in detail) passing through the rolling gap 9 moves through the rolling stand along rolling axis 8. The rolling stock exerts a force on the roller, with the force schematically indicated by arrow 10.

The rolling gap 9 can be adjusted by rotating pinion 7. The rotation of pinion 7 is transmitted via the gear ring segment 6 to the eccentric bushing 2, causing the eccentric bushing 22 to rotate about the center 13 of the needle bearing 5. As a result of the eccentricity 27 (see FIG. 2), caused by the eccentric positioning of the radial bearing 4 and the roller journal 1 in the eccentric bushing 2, the size of the rolling gap 9 increases or decreases when the eccentric bushing 2 is rotated. The position of pinion 7 is fixed when the rolling gap 9 is adjusted to the desired size.

Figure 2:
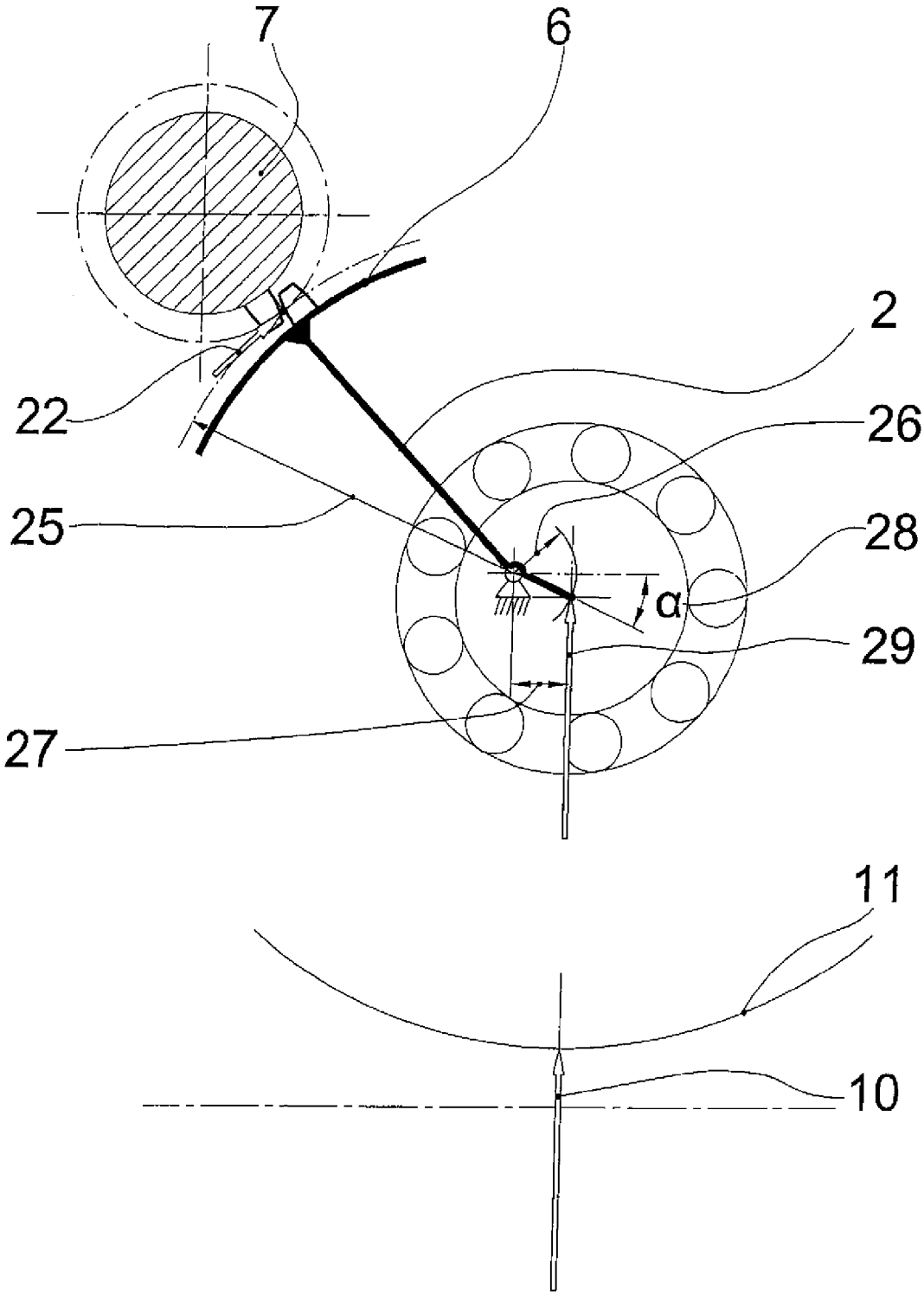
FIG. 2 shows a schematic principal illustration based on FIG. 1, with the parameters used for calculating the rolling force according to the invention.

As shown in FIG. 2, a tangential adjusting force 22 is required to hold the gear ring segment 6 in the illustrated position. The adjusting force 22 produces an adjusting torque which opposes the restoring torque caused by the rolling force 10. As the center of the roller journal 1 has an eccentricity 27 with respect to the center of the rotation 13 of the eccentric bushing 2 (center of the needle bearing 5), the rolling force 10, illustrated as a force applied to the center of the roller journal for sake of simplicity, produces a restoring torque operating about the rotation center 13 of the eccentric bushing 2. As a consequence of the low-friction support, there is essentially no need to consider any other torques or forces, so that the rolling force 10 is governed by the following relation:

$$W_{Walz}=F_{Anst}\square a/(e\square \cos\alpha)$$

wherein a=the effective lever 25 of the adjusting force 22 ($F_{Anst}$)

e=the eccentricity 27 of the eccentric bushing 2 (distance 26 of the roller journal center to the rotation center 13 of the eccentric bushing 2)

α=position angle 28 of the eccentric bushing 2 (angle of the straight line extending through the roller journal center and the rotation center 13 and the line parallel to the rolling axes 8 extending through the rotation center 13)

$F_{Walz}$=rolling force 29=rolling force 10.

While the invention has been illustrated and described in connection with currently preferred embodiments shown and described in detail, it is not intended to be limited to the details shown since various modifications and structural changes may be made without departing in any way from the spirit of the present invention. The embodiments were chosen and described in order to best explain the principles of the invention and practical application to thereby enable a person skilled in the art to best utilize the invention and various embodiments with various modifications as are suited to the particular use contemplated.

What is claimed as new and desired to be protected by Letters Patent is set forth in the appended claims and includes equivalents of the elements recited therein:

1. A method for determining a rolling force in a rolling stand, with the rolling stand having at least one roller with a roller journal rotatably supported in an eccentric bushing which is rotatably supported in a housing of the rolling stand by a low-friction bearing unit, the method comprising the steps of:

rotating the eccentric bushing to a desired position relative to the housing with an adjusting mechanism;

measuring an effective adjusting force in the adjusting mechanism when the eccentric bushing is held in the desired position; and determining a rolling force from the measured adjusting force.

2. The method of claim 1, wherein the rolling force is determined by measuring the effective adjusting force applied by the adjusting mechanism at a pivot angle by which the eccentric bushing is rotated from an initial or reference position to the desired position relative to the housing.

3. The method of claim 1, wherein the effective adjusting force in the adjusting mechanism is determined indirectly by measuring a pressing force exerted by the adjusting mechanism on the housing.

4. The method of claim 1 for use in the control of a rolling process.

5. The method of claim 1, and further comprising the step of correcting stored material data of rolling stock based on the measured effective adjusting force.

6. The method of claim 1, and further comprising the step of compensating elastic spring-back of the rolling stand based on the measured effective adjusting force.

7. The method of claim 1, wherein the rolling force is governed by the following relation:

$$F_{Walz}=F_{Anst}*a/(e*\cos\alpha)$$

wherein a is an effective lever of the adjusting force ($F_{Anst}$), e is an eccentricity of the eccentric bushing, α is a position angle of the eccentric bushing, $F_{Walz}$ is the rolling force.

8. A rolling stand, comprising:

a housing;

at least one roller having a roller journal;

an eccentric bushing rotatably supporting the roller journal;

a low-friction bearing unit for rotatably supporting the eccentric bushing in the housing;

an adjusting mechanism adapted to exert an adjusting force on the eccentric bushing for rotating the eccentric bushing with respect to the housing and maintaining the eccentric bushing in a desired position; and a measuring device disposed in the adjusting mechanism for measuring the adjusting force.

9. The rolling stand of claim 8, further comprising a measuring device for measuring a pivot angle of the eccentric bushing between the desired position and an initial or a reference position.

10. The rolling stand of claim 8, wherein the adjusting mechanism includes a gear wheel, said eccentric bushing including a gear ring or a gear ring segment which cooperates with the gear wheel.

11. The rolling stand of claim 8, wherein the adjusting mechanism includes a worm, said eccentric bushing including a worm wheel or a worm wheel segment which cooperates with the worm.

12. The rolling stand of claim 8, wherein the low-friction bearing unit has a friction coefficient of <0.2.

13. The rolling stand of claim 8, wherein the low-friction bearing unit has a friction coefficient of <0.1.

14. The rolling stand of claim 8, wherein the low-friction bearing unit has a friction coefficient of <0.05.

15. The rolling stand of claim 8, wherein the low-friction bearing unit is a needle bearing.

16. The rolling stand of claim 8, wherein the low-friction bearing is a hydro-bearing.

17. The rolling stand of claim 8, wherein the low-friction bearing unit and the housing have opposing surfaces provided with a friction-reducing coating.

18. The rolling stand of claim 8, wherein the rolling force is governed by the following relation:

$$F_{Walz}=F_{Anst}*a/(e*\cos\alpha)$$

wherein a is an effective lever of the adjusting force ($F_{Anst}$), e is an eccentricity of the eccentric bushing, $\alpha$ is a position angle of the eccentric bushing, $F_{Walz}$ is the rolling force.

* * * * *